US005163240A

United States Patent [19]

Byers

[11] Patent Number: 5,163,240

[45] Date of Patent: Nov. 17, 1992

[54] PHOTO DISPLAY DEVICE

[76] Inventor: Thomas L. Byers, 5840 Stewart Dr., Mustang, Okla. 73064

[21] Appl. No.: 591,052

[22] Filed: Oct. 1, 1990

[51] Int. Cl.[5] ..... G09F 11/02

[52] U.S. Cl. ..... 40/500; 40/533

[58] Field of Search ..... 40/373, 388, 389, 533, 40/390, 405, 475, 497, 500, 501, 530, 532, 534, 537, 377, 378, 379, 493, 494, 499, 531, 399, 506, 159, 661

[56] References Cited

U.S. PATENT DOCUMENTS

| | | | |
|---|---|---|---|
| 421,266 | 2/1890 | Glover . | |
| 686,965 | 11/1901 | Breton | 40/475 |
| 978,162 | 12/1910 | Hopkins . | |
| 1,126,814 | 2/1915 | Manetsch et al. . | |
| 1,214,732 | 2/1917 | Hopkins et al. . | |
| 1,596,741 | 8/1926 | Kranz | 40/494 |
| 1,713,140 | 5/1929 | McDonald | 40/475 |
| 1,813,442 | 7/1931 | Dobrowsky . | |
| 1,848,296 | 3/1932 | Hueber | 40/475 X |
| 2,554,941 | 5/1951 | Dobrowsky | 40/475 X |
| 2,703,744 | 3/1955 | Karper . | |
| 2,761,750 | 9/1956 | Neilsen . | |
| 3,212,205 | 10/1965 | Alleman . | |
| 3,218,743 | 11/1965 | Shneider . | |
| 3,260,006 | 7/1966 | Dunajew . | |
| 3,261,649 | 7/1966 | Erickson et al. . | |
| 3,323,243 | 6/1967 | Blair | 40/499 |
| 3,964,428 | 6/1976 | Arai . | |
| 3,973,339 | 8/1976 | Ueda . | |
| 4,021,947 | 5/1977 | Shneider . | |
| 4,215,511 | 8/1980 | Todokoro | 40/475 |
| 4,514,919 | 5/1985 | Plutsky | 40/159 |
| 4,530,176 | 7/1985 | Rejwan | 40/159 X |
| 4,599,815 | 7/1986 | Waldo . | |
| 4,832,369 | 5/1989 | Johnson et al. | 40/159 X |

FOREIGN PATENT DOCUMENTS

| | | | |
|---|---|---|---|
| 619299 | 3/1949 | United Kingdom | 40/500 |

*Primary Examiner*—Kenneth J. Dorner
*Assistant Examiner*—J. Bonifanti
*Attorney, Agent, or Firm*—Laney, Dougherty, Hessin & Beavers

[57] ABSTRACT

A device for storage and display of photographs consisting of a housing with front frame and a spindle containing photo envelopes supported mid-way across the front frame. The spindle is formed in unique manner to carry a large plurality of photo envelopes by heat welding each envelope to the spindle in close spacing. Each envelope contains two photos back-to-back, and rotation, either manually or motor controlled, indexes intermittent display of the successive photos with two photos always in view in the frame.

11 Claims, 3 Drawing Sheets

PHOTO DISPLAY DEVICE

BACKGROUND OF THE INVENTION

1. Field of the Invention

The invention relates generally to a rotary-type photo display device and, more particularly, but not by way of limitation, it relates to an improved form of device capable of exhibiting a much greater number of photographs in either automatic or manually controlled mode of operation.

2. Description of the Prior Art

There have been a number of different developments in the past that relate to card or picture display devices of the rotary type. Card index devices are of general interest only since they are generally characterized by the fact that only one side of the card need be displayed after indexing. An early U.S. Pat. No. 1,813,442 discloses a mechanized rotary-type sign display which includes the two fields of view, i.e., the front of the top card is displayed simultaneously with the backside of the bottom card. U.S. Pat. No. 1,126,814 discloses another form of picture display device wherein rotary cartridges each containing a number of pictures can be selectively displayed.

The U.S. Pat. No. 1,214,732 in the name of Hopkins et al discloses a rotary indexing apparatus for bringing successive single pictures into view. There is no viewing of the backside of the photo holder and only a single card or picture presentation is made. The U.S. Pat. No. 978,162 discloses a different form of sign or picture exhibiting apparatus wherein the multiple of pictures is rotated in a horizontal plane about a vertical axis. U.S. Pat. No. 3,218,743 discloses a picture exhibiting apparatus that uses an album-type collection of individual photographs wherein each album can be inserted in the display device for subsequent individual viewing of the pictures. Finally, the U.S. Pat. No. 421,266 discloses a rotary-type photograph viewing exhibitor in combination with parlor or office furniture wherein the picture exhibitor may be selectively rotated to exhibit photos while other utilitarian aspects of the combination are available. In this case, an extremely delicate and complicated structure of hinge-stubs, pintles, tubes and spaces are utilized to hingedly secure the individual album-leaves for selective rotary viewing.

SUMMARY OF THE INVENTION

The present invention is an improved type of rotary picture exhibiting device wherein a great number of individual picture-holding envelopes, displaying pictures from both sides, are secured about an album spindle that may be removably placed in the viewing device. Control knobs having spaced bearing races and timing belt pulleys are force-fit into the ends of the spindle which can then be received into the housing in journal bearing races. A front frame also having mating journal bearing races is then secured to the housing member to movably retain the album spindle which can then be rotated uni-directionally either manually or automatically to intermittently exhibit respective pairs of photographs, i.e., a backside photo of one envelope and the front side photo of a succeeding envelope.

Therefore, it is an object of the present invention to provide an attractive and functional photo display device that is adaptable to blend in with room decor.

It is also an object of the present invention to provide a device that offers protective storage of photographs while at the same time keeping the photos accessible for viewing.

It is still further an object of the present invention to provide a manual or automatically controlled photograph display device that is capable of exhibiting a greater number of photographs.

Finally, it is an object of the present invention to provide a photo display device that is economical to make and sell while being structurally reliable and capable of achieving pleasing aesthetic effect.

Other objects and advantages of the invention will be evident from the following detailed description when read in conjunction with the accompanying drawings which illustrate the invention.

DETAILED DESCRIPTION OF THE INVENTION

Figure 1:
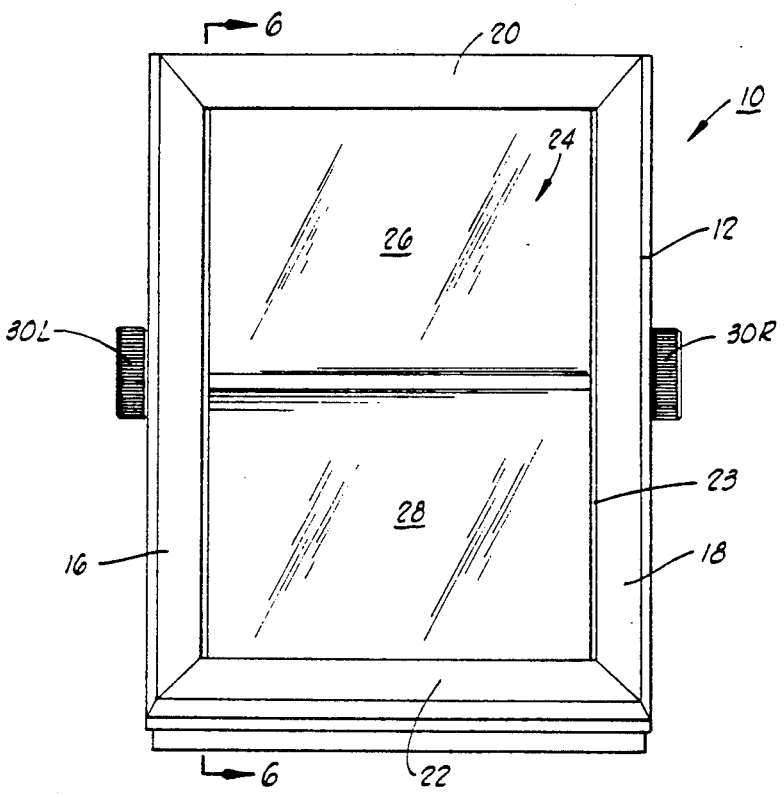
FIG. 1 is a front view of the display device of the present invention.
Figure 2:
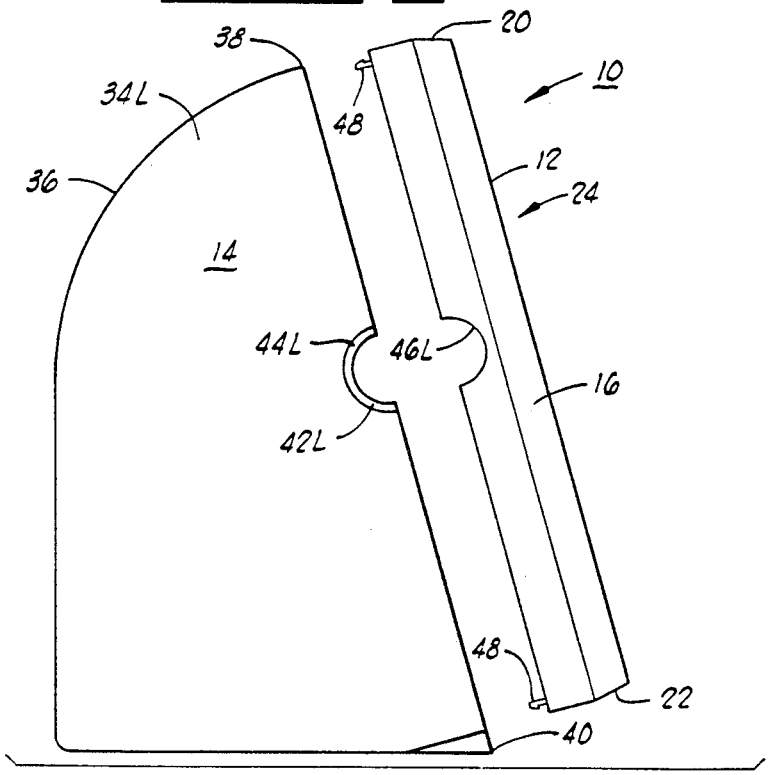
FIG. 2 is a side view in exploded form of the housing member and front frame of the present invention.

Referring to FIGS. 1 and 2, a photograph display device 10 includes a front frame 12 as snap-fit over a housing 14. The front frame 12 includes opposite sides 16 and 18, top 20 and bottom 22 formed into a rectangular shape that provides a double or dual picture field of view. A comb 23 is formed around the inner edge of frame 12. Thus, the front viewing area 24 is divided into an upper area 26 for viewing a first picture and a lower viewing area 28 displaying a second picture. The viewing areas 26 and 28 are each adapted to receive standard-sized photographs, e.g., 3½ by 5 inch snapshot prints.

Spindle knobs 30L and 30R, of identical construction, are disposed on each side of front frame 12. Referring also to FIG. 2, the assembled knobs 30L and 30R with spindle 32 (to be described) are maintained in operative position by assembly of front frame 12 and housing 14. Housing 14 is a unitary piece having side members 34L and 34R and curved back member 36 which extends all the way around from housing peak 38 to the forward portion of base 40. A semi-circular journal bearing race 42 is formed on each of housing sides 34L and 34R as a small upper race portion 44L and 44R of the race 42 formation serve as a pawl to coact with a annular groove of the respective spindle knob 30L to prevent back-up movement, as will be further described below.

As shown in FIG. 2, the front frame 12 is also formed with mating support races. The frame sides 16 and 18 each include semi-circular journal race formations 46L and 46R that are adapted to coact with the race formations 42L and 42R to rotatably support the spindle assembly, to be further described. The front frame 12 may include a plurality of catch formations 48 which coact with mating bar formations (not shown) in the housing 14 to provide a removable snap-in closure.

Figure 3A:
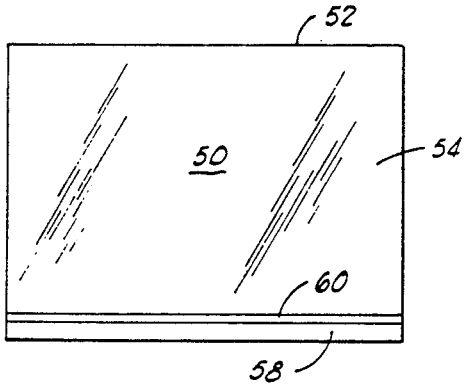
FIG. 3A is a top plan view of an envelope as used in the present invention.
Figure 3B:
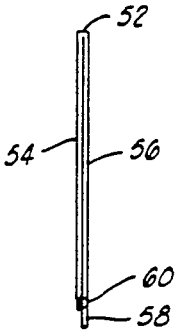
FIG. 3B is a side view in elevation of the envelope of FIG. 1A.

Referring to FIGS. 3A and 3B, a photograph envelope 50 is constructed by folding a rectangular sheet of plastic slightly offset from bisection along a fold line 52 to form sides 54 and 56 while leaving a tab portion 58. A heat weldment 60 is then drawn across the envelope 50 to form the compartment having opposite sides 54 and 56. While an of several plastic films may be utilized, very good results have been achieved using polypropylene.

Figure 4A:
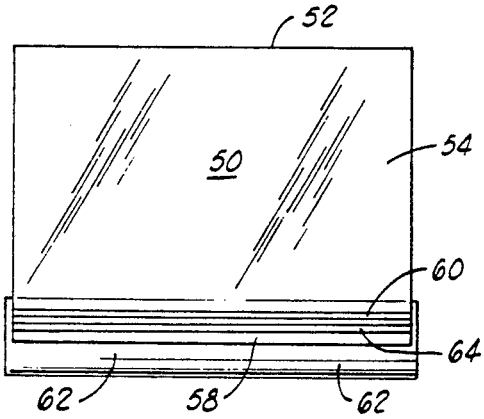
FIG. 4A is a top plan view of an envelope as it is heat welded onto a spindle in accordance with the present invention.
Figure 4B:
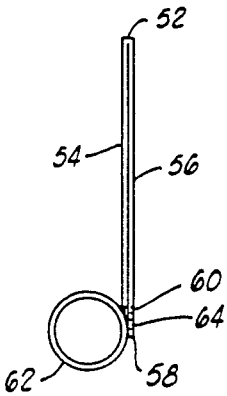
FIG. 4B is a side view in elevation of the envelope and spindle.
Figure 5:
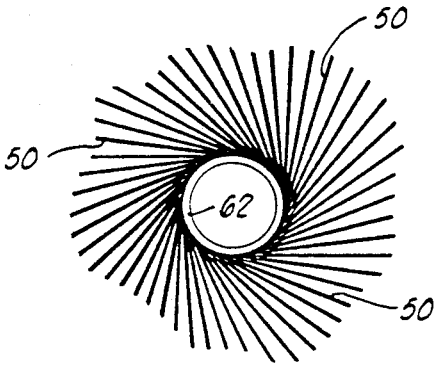
FIG. 5 is a side view in elevation of the spindle with a full complement of envelopes partially shown.

As shown in FIGS. 4A and 4B the individual envelopes 50 are secured to the spindle 62 in like manner. Thus, the spindle 62 is formed from tube stock of similar plastic, e.g., polypropylene, and another heat seal or weldment 64 is drawn along the tab portion 58 of envelope 50 to cause secure adherence to the spindle 62. The use of the same types of polymer for formation of the envelopes 50 and spindle 62 enables an easy, secure weldment to be achieved. As shown in FIG. 5, a large plurality of envelopes 50 can then be secured around the spindle 62 in close spacing with each envelope 50 freely movable in hinge-like attachment. With about a one inch diameter spindle 62, as many as 50 envelopes can be secured in the array, thus accommodating 100 photographs with two per envelope.

Figure 6:
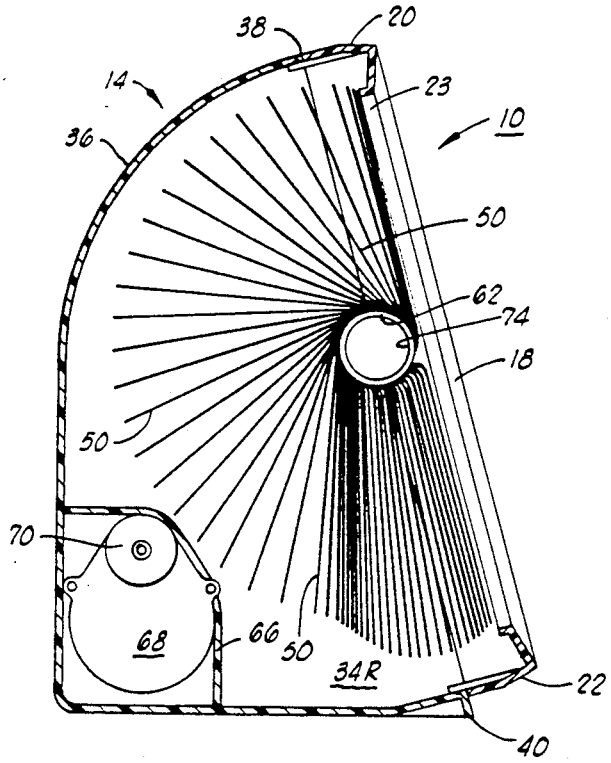
FIG. 6 is a sectional view taken along lines 6—6 of FIG. 1.

FIG. 6 is a sectional view taken along the lines 6—6 indicated in FIG. 1 and showing disposition of the internal components within the housing 14. Thus, a lower rear compartment 66 provides mounting structure for containing a suitable type of gear motor 68 providing reduced speed rotational output to a drive pulley 70 driving a timing belt 72 (see FIG. 9). The timing belt 72 is led upward and meshed into engagement with a timing belt sprocket, as will be further described in FIGS. 7-9.

Figure 8:
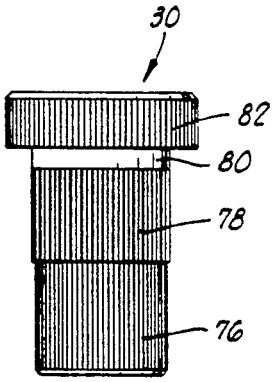
FIG. 8 is a side view in elevation of a spindle knob as used in the present invention.
Figure 9:
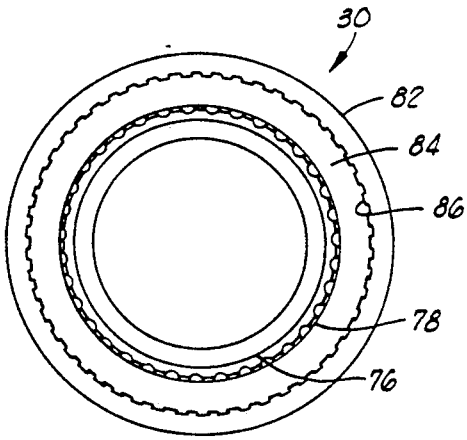
FIG. 9 is a bottom plan view of the knob of FIG. 8.

The spindle 62 is maintained in position by the journal bearing races 42L and R formed in housing side panels 34L and 34R as they coact in assembly with frame bearing races 46L and 46R (see FIG. 2). Actually, the tubular spindle 62 having inside cylindrical surface 74 receives spindle knobs 30L and 30R in opposite ends in force-fit. Referring to FIG. 8, each of the spindle knobs 30 includes a reduced diameter portion 76 having roughed surface adapted to press-fit into the inside diameter 74 of the spindle 62, and this formation extends into a timing belt sprocket gear formation 78 which, in turn, extends to a smooth circular bearing race 80 that provides rotational support within the housing/frame journal bearings. The outer end of spindle knob 30 is then formed with a knurled knob 82 that serves for manual rotation. As shown in FIG. 9, the underside of knurled knob portion 82 includes an annular recess 84 that includes ratchet notches 86 for coaction with the ratchet pawls 44L and 44R as shown in FIG. 2, which serve to prevent backward rotation of spindle 62.

Figure 7:
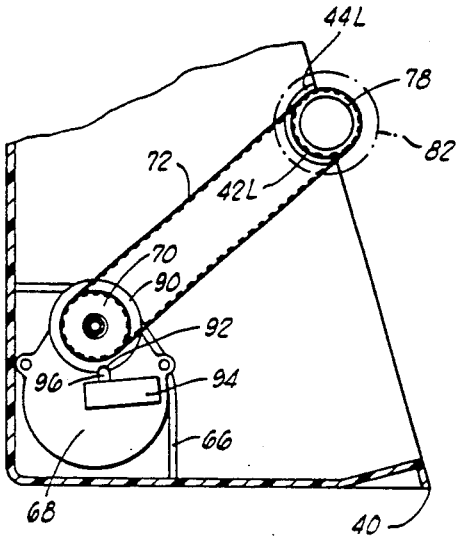
FIG. 7 is a partial side view with parts shown in phantom illustrating the drive mechanism of the present invention.

FIG. 7 illustrates the drive system of the display device 10 in cutaway form as gear motor 68 provides rotational drive output to the drive pulley 70 as drive belt 72 rotates the timing belt sprocket 78 on the spindle knob 30L. Also shown is the ratchet pawl 44L as it rides in annular groove 84 in ratcheting coaction with notches 86L. A suitable type of gear motor 68, either AC or DC can be selected from commercially available types. Primarily, selection should assure that the revolution rate of drive pulley 70 be slow enough to allow ample viewing time per photograph presentation.

Figure 10:
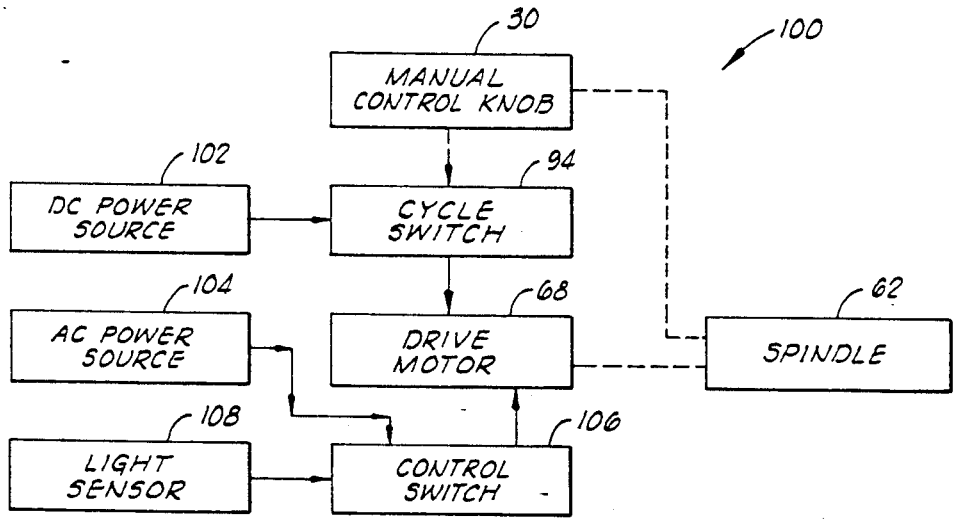
FIG. 10 is a block diagram of electric control circuitry for the present invention.

A timing disk 90 rotated synchronously with drive pulley 70 includes a notch 92 that controls operation of a cycle switch 94, a selected type of microswitch. Thus, when notch 92 allows outward projection of feeler arm 96 the gear motor is in the OFF position; however, upon rotating by momentary switching or manual rotation whereupon feeler arm 92 is depressed, the energization of gear motor 68 will continue for one full rotation, the equivalent of a complete rotation of photograph spindle 62. An alternative mode of energization is to use a light activated switch that will cause the gear motor 68 to run continually any time there is ambient light, as will be further described. FIG. 10 illustrates the control circuits 100 used with the display device 10. It is contemplated that there be three different types of operation, and these can be provided as separate production units or as a combined unit capable of all three modes of operation. A manual mode of operation is effected simply by rotating the manual control knob 30 to bring up successive pairs of photos for view. A second mode of operation, what may be termed cycle mode, operates under DC power source 102 through the cycle switch 94 to energize drive motor 68. That is, initial movement of manual control 30 moves the timing disk 90 so that microswitch 94 is energized, and this then energizes drive motor 68 for one full revolution or until timing disk 90 completes its revolution to deactivate feeler arm 92. A third or automatic mode of operation functions from an AC power source 104 to energize drive motor 68 through a control switch 106 whenever any ambient light is present and light sensor 108 actuates control switch 106. The gear motor or drive motor 68 must be selected from AC or DC types, depending upon the mode of operation.

When the spindle 62 is rotated the picture envelopes 50 are intermittently released from the upper position to the lower position (see FIG. 6). This is due to the positioning of spindle 62 relative to the comb 23 along the upper part 20 of frame 12. It can be seen that the envelopes 50 closest to comb 23 drag downward therealong before release for a certain short duration of arcuate movement of spindle 62. When envelope 50 clears comb 23 it then falls down to the lower level and the display includes in view the next photo from each of the top envelope and bottom envelope. The amount of time of view for successive pairs of pictures is function of the rotational output speed of gear motor 68.

The foregoing discloses a much improved form of photograph display device that has the capability of reliable exposition of a large number of photographs. The unit is trim and capable of achieving desirable aesthetic effect, and it may be utilized in any of several different modes of operation, depending upon the exigencies of the particular usage. Additionally, picture storage is effected by the use of a plurality of spindle/envelope units, each of which may contain upwards of 100 photographs and each being readily interchangeable in the exposition device.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A device for storage and display of photographs, comprising:

housing means including a removable viewing frame defining a field of view, and including left and right side walls for mating engagement with left and right sides of said viewing frame, and having a semi-circular race formed in each of said left and right side walls with a mating semi-circular race formed in each viewing frame side, respectively;

a spindle means formed of selected plastic removably and rotatably supported by the respective circular races formed between said left and right side and each viewing frame side and generally bisecting said viewing frame field of view;

a plurality of transparent envelopes of selected plastic having a first and second sides and a securing tab and each being adapted to contain first and second photographs that are viewable through respective first and second sides of said envelope;

a plurality of heat weldments across said spindle means to fasten the respective securing tabs for each of the plurality of transparent envelopes in successive equal spacing around said spindle means; and means for rotating said spindle means to move successive envelopes through the viewing frame intermittently with each envelope displaying successively a first side and then a second side so that both first and second photographs can be viewed.

2. A device as set forth in claim 1 wherein said spindle means comprises:

a tubular central portion for receiving said plurality of heat weldments and transparent envelopes;

first and second knobs each having an insert portion for secure positioning within the end of the tubular central portion, a next adjacent sprocket portion, a further adjacent smooth circumference for rotative engagement within the races formed in the left and right side walls of the housing means and viewing frame, and a still further adjacent knurled knob portion accessible outside of said housing means for manual control purposes.

3. A device as set forth in claim 2 which is further characterized to include:

an electric motor mounted within said housing means and energizable to provide a rotational output; and at least one belt means coupling said rotational output from the electric motor to the next adjacent sprocket portion of on of said first and second knobs.

4. A device as set forth in claim 3 which is further characterized to include:

a cycle switch that maintains the electric motor energized for one complete rotation of said spindle means.

5. A device as set forth in claim 3 which is further characterized to include:

a light sensor providing output upon sensing ambient light; and switch means activated by said output to energize said electric motor.

6. A device as set forth in claim 1 wherein:

said spindle means and said transparent envelope are each formed from the same plastic.

7. A device as set forth in claim 6 wherein: said plastic is polypropylene.

8. A device as set forth in claim 1 wherein said frame comprises:

top, bottom and opposite sides and said frame top functions as an escapement means to delay and cause intermittent release of successive envelopes into the field of view.

9. A housing for storage and display of photographs contained in envelopes secured successively about a spindle, comprising:

a housing back member that extends into a base member;

left and right housing sides secured on each side of said back member and base member to define a generally rectangular planar opening;

left and right semi-circular bearing races formed in said left and right housing sides to receive and rotatably support said spindle generally bisecting said planar opening; and a removable viewing frame securable over said planar opening to define a field of view, said viewing frame including left and right sides each having second left and right semi-circular bearing. races that align and co-act with the left and right semi-circular bearing races in the housing sides to retain said spindle rotatably therein.

10. A housing as set forth in claim 9 wherein said viewing frame further comprises:

left and right sides, a bottom and an upper part, said upper part including a comb formed along the inner edge, said comb serving as an escapement means that drags on photo envelopes at the upper level to delay and cause intermittent release of the envelopes to the lower level as a function of spindle rotation.

11. A device for storage and display of photographs, comprising:

housing means having back, base and left and right side walls with each side wall defining a semi-circular bearing race, and including a removable viewing frame defining a field of view wherein said frame sides each include semi-circular bearing race formations that coact with the sidewall bearing race formations;

a spindle means formed of selected plastic removably and rotatably supported in said bearing race formations and generally bisecting said viewing frame field of view;

a plurality of transparent envelopes of selected plastic folded to have first and second sides that are secured by first heat weldments with the second side extending to form a securing tab, and each envelope being adapted to contain first and second photographs that are viewable through respective first and second sides of said envelope;

a plurality of second heat weldments across said spindle means serving to fasten the respective securing tabs for each of the plurality of transparent envelopes successively in equal spacing around said spindle means; and means for rotating said spindle means to move successive envelopes through the viewing frame intermittently with each envelope displaying successively a first side and then a second side so that both first and second photographs can be viewed.

* * * * *